US008968975B2

(12) United States Patent
Goan et al.

(10) Patent No.: US 8,968,975 B2
(45) Date of Patent: Mar. 3, 2015

(54) TONER FOR DEVELOPING ELECTROSTATIC IMAGE

(71) Applicant: Konica Minolta, Inc., Tokyo (JP)

(72) Inventors: Kazuyoshi Goan, Tokyo (JP); Mikio Kouyama, Tokyo (JP); Hajime Tadokoro, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/169,876

(22) Filed: Jan. 31, 2014

(65) Prior Publication Data

US 2014/0228533 A1 Aug. 14, 2014

(30) Foreign Application Priority Data

Feb. 8, 2013 (JP) ..... 2013-022984

(51) Int. Cl.
*G03G 9/087* (2006.01)

(52) U.S. Cl.
CPC ..... *G03G 9/08728* (2013.01); *G03G 9/08797* (2013.01)
USPC ..... 430/105; 526/321; 526/328.5

(58) Field of Classification Search
USPC ..... 526/321, 328.5; 430/105
See application file for complete search history.

(56) References Cited

U.S. PATENT DOCUMENTS 7,230,062 B2 * 6/2007 Mouri et al. ..... 526/328.5

FOREIGN PATENT DOCUMENTS

JP 2007-057660 3/2007
JP 4267427 2/2009

OTHER PUBLICATIONS

STN Structure Search Results (Dec. 18, 2014).*

* cited by examiner

*Primary Examiner* — Vu A Nguyen
(74) *Attorney, Agent, or Firm* — Lucas & Mercanti, LLP

(57) ABSTRACT

Provided is a toner for developing an electrostatic image. The toner has excellent heat-resistant storage properties and crush resistance while having sufficient low temperature fixability. The toner for developing an electrostatic image includes toner particles that contain at least a binder resin. The binder resin contains a polymer prepared by polymerizing a polymerizable monomer represented by a following general formula (1). In the general formula (1), $R^1$ and $R^2$ each independently represent an aliphatic hydrocarbon group having 1 to 60 carbon atoms, an aliphatic group wherein some of carbon atoms of the aliphatic hydrocarbon group are substituted with an oxygen atom, or an aromatic hydrocarbon group optionally having the aliphatic hydrocarbon group or the aliphatic group as a substituent; and $R^3$ and $R^4$ each independently represent a hydrogen atom or an aliphatic hydrocarbon group.

General Formula (1)

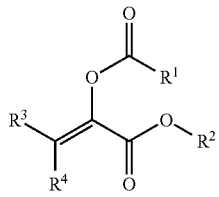

10 Claims, No Drawings

TONER FOR DEVELOPING ELECTROSTATIC IMAGE

CROSS REFERENCE TO RELATED APPLICATION

This Application claims the priority of JP Patent Application No. 2013-022984 filed on Feb. 8, 2013, which application is incorporated herein by reference in its entirety.

TECHNICAL FIELD

The present invention relates to a toner for developing an electrostatic image (hereinafter, also merely referred to as a "toner") used in image formation of an electrophotographic system.

BACKGROUND ART

As examples of a resin material conventionally used in a toner, may be mentioned polystyrene resins, styrene-acrylic copolymer resins, polyester resins, epoxy resins, butyral resins, and hybrid resins such as polyester resins having grafted acrylic resins. The design of a resin material depends on an application of the toner.

Especially, in a resin material of the toner for heat roller fixing, fixing properties to a recording medium and improvement in offset resistance are required. Thus, a thermoplastic resin having a high molecular weight or a partially crosslinked thermoplastic resin has been largely employed.

As printers and copying machines are operated at higher speed with further saved energy, a toner having excellent low temperature fixability is increasingly required. When the resin material as described above is employed, the temperature for melting and fixing a toner (fixing temperature) needs to be set high. Therefore, it is difficult to achieve energy saving.

For developing low temperature fixability in a toner, a resin material having a low melting temperature and a low melting viscosity needs to be employed. For this purpose, it is important to use a resin material having a low glass transition temperature (Tg) and a low molecular weight.

However, there arises a new problem in that the toner including such a resin material has a low heat-resistant storage properties (blocking resistance).

Thus, it is essentially difficult to balance between low temperature fixability and heat-resistant storage properties in a toner.

For solving the above-described problem, there has been proposed a toner in which a non-crystalline resin is contained in a core particle and the surface thereof is covered with a crystalline polyester resin (for example, see Patent Literature 1).

However, a crystalline polyester resin has a property of being hard but brittle. Therefore, the toner is easily crushed when stirred in a developing device. The crush of a toner significantly occurs especially in a high-speed machine.

Patent Literature 2 has proposed a technology of mixing a crystalline resin having a low melting point and a non-crystalline resin, and controlling the compatibility to obtain low temperature fixability.

However, as the compatibility between a crystalline resin and a non-crystalline resin proceeds, plasticization of the resin mixture occurs. Therefore, there is a problem in that sufficient heat-resistant storage properties (blocking resistance) cannot be obtained.

In a vinyl-based resin such as a styrene-acrylic copolymer resin having high versatility, a resin having a low molecular weight needs to be employed in order to develop low temperature fixability. However, in this case, there is a problem in that sufficient crush resistance cannot be obtained.

When such a toner is used for an extended period, the toner is fractured when subjected to a friction with a carrier in a developing device to become a fine toner. The fine toner is likely to adhere to the surface of a carrier. The fine toner is further fused to a carrier, causing a charge providing function of a carrier to decrease. Therefore, the charge amount of a toner decreases. As a result, the toner with charge defects is scattered. Therefore, there is a problem such as occurrence of background fogging.

In the end, in the toner containing a crystalline resin, low temperature fixability, which is an advantage of a crystalline resin, can be obtained, but heat-resistant storage properties and crush resistance cannot be sufficiently satisfied.

CITATION LIST

Patent Literature

Patent Literature: Japanese Patent Application Laid-Open No. 2007-57660

Patent Literature 2: Japanese Patent No. 4267427

SUMMARY OF INVENTION

Technical Problem

The present invention has been made in view of the foregoing circumstances, and has as its object the provision of a toner for developing an electrostatic image, the toner having excellent heat-resistant storage properties and crush resistance while having sufficient low temperature fixability.

Solution to Problem

To achieve at least one of the above-mentioned objects, a toner for developing an electrostatic image reflecting one aspect of the present invention includes toner particles containing at least a binder resin, wherein the binder resin contains a polymer prepared by polymerizing a polymerizable monomer represented by a following general formula (1).

[Chemical Formula 1]

General Formula (1)

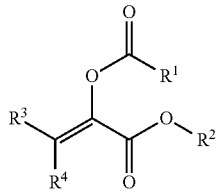

In the general formula (1), $R^1$ and $R^2$ each independently represent an aliphatic hydrocarbon group having 1 to 60 carbon atoms, an aliphatic group wherein some of carbon atoms of the aliphatic hydrocarbon group are substituted with an oxygen atom, or an aromatic hydrocarbon group that may optionally have the aliphatic hydrocarbon group or the aliphatic group as a substituent; and $R^3$ and $R^4$ each independently represent a hydrogen atom or an aliphatic hydrocarbon group.

In the above-mentioned toner for developing an electrostatic image, the polymer is preferably prepared by copolymerizing the polymerizable monomer represented by the general formula (1) and butyl acrylate.

In the above-mentioned toner for developing an electrostatic image, a content of the butyl acrylate is preferably 5 to 40% by mass per a total amount of monomers for forming the polymer.

The above-mentioned toner for developing an electrostatic image preferably has a glass transition temperature of 40 to 80° C.

To achieve at least one of the above-mentioned objects, a toner for developing an electrostatic image reflecting one aspect of includes toner particles containing at least a binder resin, wherein the binder resin contains a copolymer prepared by copolymerizing a polymerizable monomer represented by a following general formula (2) and a polymerizable monomer represented by a following general formula (3)

[Chemical Formula 2]

General Formula (2)

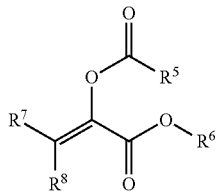

In the general formula (2), $R^5$ and $R^6$ each independently represent an aliphatic hydrocarbon group having 3 or less carbon atoms, an aliphatic group wherein some of carbon atoms of the aliphatic hydrocarbon group are substituted with an oxygen atom, or an aromatic hydrocarbon group optionally having the aliphatic hydrocarbon group or the aliphatic group as a substituent wherein the number of condensations is not more than 3; and $R^7$ and $R^8$ each independently represent a hydrogen atom or an aliphatic hydrocarbon group having 3 or less carbon atoms.

[Chemical Formula 3]

General Formula (3)

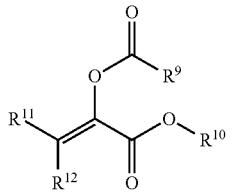

In the general formula (3), $R^9$ and $R^{10}$ each independently represent an aliphatic hydrocarbon group, an aliphatic group wherein some of carbon atoms of the aliphatic hydrocarbon group are substituted with an oxygen atom, or an aromatic hydrocarbon group that may optionally have the aliphatic hydrocarbon group or the aliphatic group as a substituent; provided that at least one of $R^9$ and $R^{10}$ represents an aliphatic hydrocarbon group having 4 to 60 carbon atoms, or an aliphatic group wherein some of carbon atoms of the aliphatic hydrocarbon group are substituted with an oxygen atom. $R^{11}$ and $R^{12}$ each independently represent a hydrogen atom or an aliphatic hydrocarbon group.

In the copolymer in the above-mentioned toner for developing an electrostatic image, a mass ratio between the polymerizable monomer represented by the general formula (2) and the polymerizable monomer represented by the general formula (3) is preferably 50:50 to 99:1.

In the above-mentioned toner for developing an electrostatic image, a total content of the polymerizable monomer represented by the general formula (2) and the polymerizable monomer represented by the general formula (3) is preferably 40 to 95% by mass per a total amount of monomers for forming the copolymer.

In the above-mentioned toner for developing an electrostatic image, the copolymer is preferably prepared by copolymerizing the polymerizable monomer represented by the general formula (2), the polymerizable monomer represented by the general formula (3), and butyl acrylate.

In the above-mentioned toner for developing an electrostatic image, a content of the butyl acrylate is preferably 5 to 40% by mass per a total amount of monomers for forming the copolymer.

The above-mentioned toner for developing an electrostatic image preferably has a glass transition temperature of 40 to 80° C.

Advantageous Effects of Invention

According to the above-mentioned toner for developing an electrostatic image, the binder resin contains at least one of a polymer (hereinafter, also referred to as a "specific acrylic-based polymer") prepared by polymerizing a polymerizable monomer represented by the general formula (1) (hereinafter, also referred to as a "specific acrylic-based monomer (1)"), and a copolymer (hereinafter, also referred to as a "specific acrylic-based copolymer") prepared by copolymerizing the polymerizable monomer represented by the general formula (2) (hereinafter, also referred to as a "specific acrylic-based monomer (2)") and the polymerizable monomer represented by the general formula (3) (hereinafter, also referred to as a "specific acrylic-based monomer (3)"). Accordingly, the toner has excellent heat-resistant storage properties and crush resistance while having sufficient low temperature fixability.

DESCRIPTION OF EMBODIMENTS

The present invention will be described in detail below.

Toner:

The toner according to the present invention includes toner particles containing a binder resin that include at least one of a specific acrylic-based polymer prepared by polymerizing a specific acrylic-based monomer (1), and a specific acrylic-based copolymer prepared by copolymerizing a specific acrylic-based monomer (2) and a specific acrylic-based monomer (3). Furthermore, the toner particle can optionally contain a coloring agent, magnetic powder, a parting agent, a charge control agent, and the like. Also, external additives such as a fluidizer, a cleaning auxiliary can be added to the toner particle.

Binder Resin:

Specific Acrylic-Based Polymer:

The specific acrylic-based polymer that can be configured as a binder resin in the toner according to the present invention is formed using at least the specific acrylic-based monomer (1) as a monomer.

In the general formula (1) described above representing the specific acrylic-based monomer (1), $R^1$ and $R^2$ each independently represent an aliphatic hydrocarbon group having 1 to 60 carbon atoms, an aliphatic group wherein some of carbon atoms of the aliphatic hydrocarbon group having 1 to 60 carbon atoms are substituted with an oxygen atom (hereinafter, also referred to as a "specific aliphatic group (1)"), or an aromatic hydrocarbon group optionally having the aliphatic hydrocarbon group having 1 to 60 carbon atoms or the specific aliphatic group (1) as a substituent.

In the aliphatic hydrocarbon group having 1 to 60 carbon atoms that can be selected as $R^1$ and $R^2$, the number of carbon atoms constituting a main chain may be 1 to 60. As specific examples thereof, may be mentioned a methyl group, an ethyl group, an n-propyl group, an isopropyl group, a t-butyl group, an isobutyl group, a 1,1-dimethyl propyl group, a 1,1,2-trimethyl propyl group, a 1,2,2-trimethyl propyl group, a 2,2-dimethyl propyl group, a 1,2-dimethyl propyl group, a 2-methyl propyl group, a 1-ethyl propyl group, a 1,1,2,2-tetramethyl propyl group, an n-butyl group, an n-pentyl group, an n-hexyl group, an n-heptyl group, an n-octyl group, an n-nonyl group, an n-decyl group, an n-decenyl group, a lauryl group, a myristyl group, a myristoleyl group, an n-pentadecyl group, an n-pentadecenyl group, a palmityl group, a palmitoleyl group, an n-hexadecadienyl group, an n-hexadecatrienyl group, an n-hexadecatetraenyl group, an n-heptadecanyl group, an n-heptadecenyl group, a stearyl group, an oleyl group, a linolyl group, an α-linolenyl group, a γ-linolenyl group, an n-octadecatetraenyl group, an arachidinyl group, an n-icosenyl group, an n-icosadienyl group, an n-icosatrienyl group, an n-icosatetraenyl group, an arachidonyl group, an n-icosapentaenyl group, an n-henicosapentadecenyl group, a behenyl group, an n-docosenyl group, an n-docosadienyl group, an n-docosatetradecenyl group, an n-docosapentaenyl group, an n-docosahexaenyl group, a lignocerinyl group, and a tetracosenyl group. Among these, an aliphatic hydrocarbon group having 20 or less carbon atoms constituting a main chain is preferred in view of easy synthesis and purification of a monomer. As examples thereof, may be mentioned a methyl group, an ethyl group, an isopropyl group, a t-butyl group, an n-butyl group, an n-pentyl group, an n-hexyl group, an n-heptyl group, an n-octyl group, an n-nonyl group, an n-decyl group, a lauryl group, an n-pentadecyl group, and a stearyl group. An aliphatic hydrocarbon group having 1 to 10 carbon atoms is more preferred.

As examples of the specific aliphatic group (1) that can be selected as $R^1$ and $R^2$, may be mentioned a 1-methoxypropyl group, a (1-methylthio)ethyl group, a dimethylethylsilyl group, a dimethylaminomethyl group, a 2-ethoxyethyl group, a 3-ethoxydecyl group, a 2-methylthiohexyl group, a 5-trimethylsilylpentyl group, and a 5-dimethylaminooctyl group. Among these, an aliphatic group containing an ether bond such as a 1-methoxypropyl group and a 2-ethoxyethyl group is preferred, from the viewpoint of stabilization of thermophysical properties. The amount of substituted oxygen atoms in such a specific aliphatic group (1) is preferably not more than a half of the whole of carbon atoms. When the amount of substituted oxygen atoms exceeds a half of the whole of carbon atoms, the elastic modulus and the heat resistance of the obtained specific acrylic-based polymer may be reduced.

As examples of the aromatic hydrocarbon group optionally having the aliphatic hydrocarbon group having 1 to 60 carbon atoms or the specific aliphatic group (1) as a substituent, that can be selected as $R^1$ and $R^2$, may be mentioned a phenyl group, a naphthyl group, an anthryl group and a phenanthryl group as an unsubstituted group; and an isopropyl phenyl group, an ethyl naphthyl group, a methoxy anthryl group and a dimethylphenanthryl group as a group having a substituent. Among these, a phenyl group is preferred from the viewpoint of easy synthesis of a monomer.

In the general formula (1), as $R^1$ and $R^2$, it is particularly preferred that, $R^1$ is an aliphatic hydrocarbon group having 1 to 4 carbon atoms, and $R^2$ is an aliphatic hydrocarbon group having 5 to 20 carbon atoms.

Here, a "main chain" refers to the longest chain constituting an aliphatic group.

Also, in the general formula (1), $R^3$ and $R^4$ each independently represent a hydrogen atom or an aliphatic hydrocarbon group.

As the aliphatic hydrocarbon group that can be selected as $R^3$ and $R^4$, an aliphatic hydrocarbon group having 4 or less carbon atoms, specifically, having 4 or less carbon atoms constituting a main chain, is preferred from the viewpoint of further improvement in polymerization reaction properties. A methyl group is particularly preferred.

In the general formula (1), as $R^3$ and $R^4$, at least one of $R^3$ and $R^4$ is preferably a hydrogen atom from the viewpoint of further improvement in polymerization reaction properties. It is particularly preferred that $R^3$ and $R^4$ are each a hydrogen atom.

As examples of the specific acrylic-based monomer (1), may be mentioned, but not limited to, Compounds (1) to (5) below.

TABLE 1

| Specific examples | In general formula (1) | | | |
|---|---|---|---|---|
| | $R^1$ | $R^2$ | $R^3$ | $R^4$ |
| Compound (1) | Methyl group | Ethyl group | Hydrogen atom | Hydrogen atom |
| Compound (2) | Methyl group | n-butyl group | Hydrogen atom | Hydrogen atom |
| Compound (3) | Methyl group | n-octyl group | Hydrogen atom | Hydrogen atom |
| Compound (4) | Methyl group | n-octyl group | Hydrogen atom | Methyl group |
| Compound (5) | Methyl group | n-butyl group | Methyl group | Methyl group |

The specific acrylic-based monomer (1) as described above may be used singly or in any combination thereof.

The specific acrylic-based polymer according to the present invention is prepared by polymerizing the specific acrylic-based monomer (1). The polymerization method that can be adopted in such polymerization is not particularly limited, and a publicly known method can appropriately be adopted. As examples of such a publicly known polymerization method, may be mentioned an emulsion polymerization method, a soap-free emulsion polymerization method, a solution polymerization method, a polymerization method using only a monomer without using a solvent, a suspension polymerization method, a radical polymerization method, an anionic polymerization method, and a photopolymerization method. Also, as a polymerization initiator (2,2'-azobisisobutyronitrile, benzoyl peroxide, ammonium persulfate, n-butyl lithium and the like) and a solvent (xylene, toluene, isopropanol, water and the like), which are used in the above-described polymerization method, publicly known polymerization initiators and solvents may be appropriately selected for use in polymerization.

Also, the conditions in such a polymerization reaction can be appropriately set according to an adopted polymerization method, and are not particularly limited. For example, adopted conditions may include a contained amount of a polymerization initiator of about 0.01 to 10 mol % with respect to a monomer, a monomer concentration of about 10 to 100% by mass, an atmosphere of an inert gas such as nitrogen, a reaction temperature of about −100 to 150° C., and a reaction time of about 1 to 48 hours.

In the present invention, the specific acrylic-based polymer may be a homopolymer formed only of the specific acrylic-based monomer (1). However, a copolymer formed from the specific acrylic-based monomer (1) and another polymerizable monomer is preferred.

As examples of another polymerizable monomer that can be copolymerized with the specific acrylic-based monomer (1), may be mentioned a (meth)acrylic ester-based monomer, a styrene-based monomer, and a polymerizable monomer having an ionic dissociation group. Especially, as another polymerizable monomer, a (meth)acrylic ester-based monomer and a styrene-based monomer are preferably used.

As specific examples of the (meth)acrylic ester-based monomer, may be mentioned acrylate derivatives such as methyl acrylate, ethyl acrylate, n-butyl acrylate, isopropyl acrylate, isobutyl acrylate, t-butyl acrylate, n-octyl acrylate, 2-ethylhexyl acrylate, cyclohexyl acrylate, stearyl acrylate, lauryl acrylate, phenyl acrylate, dimethylaminoethyl acrylate, and diethylamino ethyl acrylate; and methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, cyclohexyl methacrylate, stearyl methacrylate, lauryl methacrylate, phenyl methacrylate, dimethyl amino ethyl methacrylate, and diethylamino ethyl methacrylate. Among these, n-butyl acrylate and 2-ethyl hexyl acrylate are preferably used. These may be used either singly or in any combination thereof. Among these, butyl acrylate is particularly preferably used from the viewpoint of stabilization of thermo-physical properties.

As specific examples of the styrene-based monomer, may be mentioned styrene or styrene derivatives such as styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene and p-n-dodecyl styrene. Among these, styrene is preferably used. These may be used either singly or in any combination thereof.

The ionic dissociation group refers to a substituent such as a carboxyl group, a sulfonic acid group and a phosphoric acid group. As specific examples of the polymerizable monomer having an ionic dissociation group, may be mentioned acrylic acid, methacrylic acid, maleic acid, itaconic acid, fumaric acid, styrene sulfonic acid and acrylamide propyl sulfonic acid. Among these, acrylic acid and methacrylic acid are preferably used. These may be used either singly or in any combination thereof.

The specific acrylic-based monomer (1) is a compound having especially favorable radical polymerization properties and being polymerizable with a vinyl monomer such as styrene, methyl methacrylate and acrylonitrile. In order to obtain a binder resin having a storage modulus necessary for a toner to develop low temperature fixability, the length of a side chain needs to be adequately controlled. The specific acrylic-based monomer (1) according to the present invention has a structural characteristic of having two ester groups in the monomer. These ester groups act as a bulky substituent in the polymer. Therefore, a main chain becomes remarkably rigid. Thus, a normal temperature modulus and heat resistance can be improved while maintaining low temperature fixability. Also, even when the specific acrylic-based monomer (1) and butyl acrylate are copolymerized, the substituents do not repel each other, and the entanglement between molecules is increased. Thus, the physical durability of the toner can be improved.

The content (copolymerization ratio) of the specific acrylic-based monomer (1) is preferably 40 to 95% by mass, more preferably 50 to 90% by mass, per a total amount of monomers for forming the specific acrylic-based polymer.

When the content of the specific acrylic-based monomer (1) falls within the above-described range, excellent heat-resistant storage properties and crush resistance can be ensured while having sufficient low temperature fixability.

Also, the content (copolymerization ratio) of the (meth) acrylic ester-based monomer in the copolymer configured by the specific acrylic-based monomer (1) and the (meth)acrylic ester-based monomer is preferably 5 to 50% by mass per a total amount of monomers for forming the specific acrylic-based polymer. Especially, when butyl acrylate is used as the (meth)acrylic ester-based monomer, the content (copolymerization ratio) of butyl acrylate is 5 to 40% by mass per a total amount of monomers for forming the specific acrylic-based polymer.

Furthermore, the content (copolymerization ratio) of the styrene-based monomer in the copolymer configured by the specific acrylic-based monomer (1) and the styrene-based monomer is preferably 5 to 20% by mass per a total amount of monomers for forming the specific acrylic-based polymer.

In the specific acrylic-based polymer, the peak molecular weight obtained by a molecular weight distribution based on a styrene equivalent molecular weight measured by gel permeation chromatography (GPC) is preferably 1,500 to 60,000, more preferably 3,000 to 40,000. Here, the peak molecular weight refers to a molecular weight corresponding to an elution time of a peak top in a molecular weight distribution. When a plurality of peak tops exist in a molecular weight distribution, the peak molecular weight refers to a molecular weight corresponding to an elution time at a peak top having the largest peak area ratio.

In the present invention, the peak molecular weight of the specific acrylic-based polymer is measured by gel permeation chromatography (GPC). Specifically, using an apparatus "HLC-8220" (manufactured by Tosoh Corporation) and a column "TSK guard column+TSK gel Super HZ-M 3 in series" (manufactured by Tosoh Corporation), tetrahydrofuran (THF) is flown as a carrier solvent at a flow rate of 0.2 ml/min while maintaining the column temperature at 40° C. Under the dissolution condition of treating a measurement sample using an ultrasonic dispersion machine at room temperature for 5 minutes, the measurement sample (a specific acrylic-based polymer) is dissolved in tetrahydrofuran so that the solution has a concentration of 1 mg/ml. Next, a treatment is performed using a membrane filter having a pore size of 0.2 μm to obtain a sample solution. Then, 10 μl of this sample solution is injected in the apparatus together with the above-described carrier solvent, and detection is performed using a refractive index detector (an RI detector). The molecular weight distribution of the measurement sample is calculated using a calibration curve measured with monodispersed polystyrene standard particles. For measuring the calibration curve, 10 different polystyrenes were used.

Specific Acrylic-Based Copolymer:

The specific acrylic-based copolymer that can be configured as a binder resin in the toner according to the present invention is formed by using as a monomer at least two of a specific acrylic-based monomer (2) and a specific acrylic-based monomer (3).

In the present invention, two or more specific acrylic-based polymers each having a side chain (specifically, $R^6$ in the specific acrylic-based monomer (2) and $R^{10}$ in the specific acrylic-based monomer (3)) with a different length are used. Accordingly, there is no repulsion between substituents, and the entanglement between molecules is increased. Thus, the physical durability of a toner can be improved. Also, by using the same type of acrylic-based monomers, compatibility is improved, and a polymerization reaction can be stabilized.

Also, the specific acrylic-based copolymer may be regarded as one aspect of the above-described specific acrylic-based polymer. That is, the specific acrylic-based copolymer is prepared by copolymerizing different two specific acrylic-based monomers (1), and regarded as one of the aspects of the specific acrylic-based polymer.

In the general formula (2) above representing the specific acrylic-based monomer (2), $R^5$ and $R^6$ each independently represent an aliphatic hydrocarbon group having 3 or less carbon atoms, an aliphatic group wherein some of carbon atoms of the aliphatic hydrocarbon group having 3 or less carbon atoms (hereinafter, also referred to as "specific aliphatic group (2)") are substituted with an oxygen atom, or an aromatic hydrocarbon group optionally having the aliphatic hydrocarbon group having 3 or less carbon atoms or the specific aliphatic group (2) as a substituent wherein the number of condensations is not more than 3.

In the aliphatic hydrocarbon group having 3 or less carbon atoms that can be selected as $R^5$ and $R^6$, the number of carbon atoms constituting a main chain may be not more than 3. As specific examples thereof, may be mentioned a methyl group, an ethyl group, an n-propyl group, an isopropyl group, a t-butyl group, an isobutyl group, a 1,1-dimethyl propyl group, a 1,1,2-trimethyl propyl group, a 1,2,2-trimethyl propyl group, a 2,2-dimethyl propyl group, a 1,2-dimethyl propyl group, a 2-methyl propyl group, a 1-ethyl propyl group, and a 1,1,2,2-tetramethyl propyl group. Among these, from the viewpoint of easy synthesis and purification of a monomer, a methyl group, an ethyl group, an isopropyl group and a t-butyl group are preferred.

When both $R^5$ and $R^6$ are the aliphatic hydrocarbon group, both are preferably a methyl group, an ethyl group, an isopropyl group or a t-butyl group, further preferably a methyl group or an ethyl group, from the viewpoint of improvement in the elastic modulus.

As examples of the specific aliphatic group (2) that can be selected as $R^5$ and $R^6$, may be mentioned a 1-methoxypropyl group, a (1-methylthio) ethyl group, a dimethylethylsilyl group, and a dimethylaminomethyl group. Among these, an aliphatic group containing an ether bond is preferred from the viewpoint of stabilization of thermo-physical properties. In this case, the amount of substituted oxygen atoms in such a specific aliphatic group (2) is preferably not more than a half of the whole of carbon atoms. When the amount of substituted oxygen atoms exceeds a half of the whole of carbon atoms, the elastic modulus and the heat resistance of the obtained specific acrylic-based copolymer are likely to be reduced.

As examples of the aromatic hydrocarbon group optionally having the aliphatic hydrocarbon group having 3 or less carbon atoms or the specific aliphatic group (2) as a substituent wherein the number of condensations is not more than 3, that can be selected as $R^5$ and $R^6$, may be mentioned a phenyl group, a naphthyl group, and an anthryl group as an unsubstituted group; and an isopropyl phenyl group, an ethyl naphthyl group, and a methoxy anthryl group as a group having a substituent. Among these, a phenyl group is preferred from the viewpoint of easy synthesis of a monomer.

Here, "the number of condensations" refers to the number of aromatic rings that are condensed in a state of not containing a hetero atom and a substituent.

As $R^5$ and $R^6$ in the general formula (2), from the viewpoint of further improving a polymerization reaction in combination with the general formula (3), it is more preferred that at least one of $R^5$ and $R^6$ is the aliphatic hydrocarbon group having 3 or less carbon atoms, and it is further preferred that they each are the aliphatic hydrocarbon group having 3 or less carbon atoms.

Also, in the general formula (2), $R^7$ and $R^8$ each independently represent a hydrogen atom or an aliphatic hydrocarbon group having 3 or less carbon atoms.

The aliphatic hydrocarbon group having 3 or less carbon atoms that can be selected as $R^7$ and $R^8$, is not limited as long as the number of carbon atoms constituting a main chain is not more than 3. As specific examples thereof, may be mentioned those similar to the specific examples mentioned with respect to the aliphatic hydrocarbon group having 3 or less carbon atoms that can be selected as $R^5$ and $R^6$.

As $R^7$ and $R^8$ in the general formula (2), from the viewpoint of further improving a polymerization reaction, it is preferred that at least one of them is a hydrogen atom, and it is particularly preferred that they each are a hydrogen atom.

The specific acrylic-based monomer (2) as described above may be used singly or in any combination thereof.

In the general formula (3) above representing the specific acrylic-based monomer (3), $R^9$ and $R^{10}$ each independently represent an aliphatic hydrocarbon group, an aliphatic group wherein some of carbon atoms of the aliphatic hydrocarbon group are substituted with an oxygen atom (hereinafter, also referred to as a "specific aliphatic group (3)"), or an aromatic hydrocarbon group optionally having the aliphatic hydrocarbon group or the specific aliphatic group (3) as a substituent. However, at least one of $R^9$ and $R^{10}$ represents an aliphatic hydrocarbon group having 4 to 60 carbon atoms, or an aliphatic group wherein some of carbon atoms of the aliphatic hydrocarbon group having 4 to 60 carbon atoms are substituted with an oxygen atom (hereinafter, also referred to as a "specific aliphatic group (3')").

In the aliphatic hydrocarbon group having 4 to 60 carbon atoms that can be selected as $R^9$ and $R^{10}$, the number of carbon atoms constituting a main chain may be 4 to 60. As specific examples thereof, may be mentioned an n-butyl group, an n-pentyl group, an n-hexyl group, an n-heptyl group, an n-octyl group, an n-nonyl group, an n-decyl group, an n-decenyl group, a lauryl group, a myristyl group, a myristoleyl group, an n-pentadecyl group, an n-pentadecenyl group, a palmityl group, a palmitoleyl group, an n-hexadecadienyl group, an n-hexadecatrienyl group, an n-hexadecatetraenyl group, an n-heptadecanyl group, an n-heptadecenyl group, a stearyl group, an oleyl group, a linolyl group, an α-linolenyl group, a γ-linolenyl group, an n-octadecatetraenyl group, an arachidinyl group, an n-icosenyl group, an n-icosadienyl group, an n-icosatrienyl group, an n-icosatetraenyl group, an arachidonyl group, an n-icosapentaenyl group, an n-henicosapentadecenyl group, a behenyl group, an n-docosenyl group, an n-docosadienyl group, an n-docosatetradecenyl group, an n-docosapentaenyl group, an n-docosahexaenyl group, a lignocerinyl group, and tetracosenyl. Among these, from the viewpoint of easy synthesis of a monomer and the elastic modulus of the obtained specific acrylic-based copolymer, may be preferred an n-butyl group, an n-pentyl group, an n-hexyl group, an n-heptyl group, an n-octyl group, an n-nonyl group, an n-decyl group, a lauryl group, an n-pentadecyl group and stearyl, each having 4 to 20 carbon atoms constituting a main chain. In this case, the aliphatic hydrocarbon group having 4 to 60 carbon atoms may have, as a substituent, an alkyl group or a group wherein some of carbon atoms in the alkyl group are substituted with oxygen in the range that the number of carbon atoms in a main chain does not exceed 60.

The specific aliphatic group (3') that can be selected as $R^9$ and $R^{10}$ is not particularly limited. As examples thereof, may be mentioned a 2-ethoxyethyl group and a 3-ethoxydecyl group. Among these, an aliphatic group containing an ether bond is preferred from the viewpoint of stabilization of thermo-physical properties.

Also, when $R^9$ or $R^{10}$ does not correspond to an aliphatic hydrocarbon group having 4 to 60 carbon atoms, or a specific aliphatic group (3'), $R^9$ or $R^{10}$ represents a hydrocarbon group, the specific aliphatic group (3), or an aromatic hydrocarbon group optionally having the aliphatic hydrocarbon group or the specific aliphatic group (3) as a substituent. From the viewpoint of easy purification during synthesis of a monomer, the aliphatic hydrocarbon group is more preferred. This is because when both $R^9$ and $R^{10}$ have a longer main chain in which the number of carbon atoms constituting a main chain becomes a larger value, the boiling point of a monomer becomes higher, causing purification by distillation and the like to be likely to become difficult to perform. As such an aliphatic hydrocarbon group, an alkyl group having 1 to 20 carbon atoms is more preferred; an alkyl group having 1 to 10 carbon atoms is further preferred; and a methyl group and an ethyl group are particularly preferred. In this case, such an aliphatic hydrocarbon group may have a liner chain shape or a branched chain shape. Also, as examples of the specific aliphatic group (3), may be mentioned a 1-methoxypropyl group and a 2-ethoxyethyl group. As examples of the aromatic hydrocarbon group optionally having the aliphatic hydrocarbon group or the specific aliphatic group (3) as a substituent, may be mentioned a phenyl group and an isopropyl phenyl group.

As $R^9$ and $R^{10}$ in the general formula (3), from the viewpoint of further improving a polymerization reaction in combination with the general formula (2), it is more preferred that at least one of $R^9$ and $R^{19}$ is an aliphatic hydrocarbon group having 4 or more carbon atoms, and it is further preferred that one of them is an aliphatic hydrocarbon group having 3 or less carbon atoms.

Also, in the general formula (3), $R^{11}$ and $R^{12}$ each independently represent a hydrogen atom or an aliphatic hydrocarbon group.

As the aliphatic hydrocarbon group that can be selected as $R^{11}$ and $R^{12}$, from the viewpoint of further improving polymerization reaction properties, an aliphatic hydrocarbon group having 4 or less carbon atoms, specifically having 4 or less carbon atoms constituting a main chain, is preferred; and a methyl group is particularly preferred.

As $R^{11}$ and $R^{12}$ in the general formula (3), from the viewpoint of further improving polymerization reaction properties, it is preferred that at least one of them is a hydrogen atom; and it is particularly preferred that they each are a hydrogen atom.

The specific acrylic-based monomer (3) as described above may be used singly or in any combination thereof.

The specific acrylic-based copolymer according to the present invention is prepared by copolymerizing at least the specific acrylic-based monomer (2) and the specific acrylic-based monomer (3). The polymerization method that can be adopted in such polymerization is not particularly limited, and a publicly known method can be appropriately adopted. As examples of such a publicly known polymerization method, may be mentioned an emulsion polymerization method, a soap-free emulsion polymerization method, a solution polymerization method, a polymerization method using only a monomer without using a solvent, a suspension polymerization method, a radical polymerization method, an anionic polymerization method, and a photopolymerization method. Also, as a polymerization initiator (2,2'-azobisisobutyronitrile, benzoyl peroxide, ammonium persulfate, n-butyl lithium and the like) and a solvent (xylene, toluene, isopropanol, water and the like), which are used in the above-described polymerization method, publicly known polymerization initiators and solvents may be appropriately selected to be used.

Also, the condition in such a polymerization reaction can be appropriately set according to an adopted polymerization method, and is not particularly limited. For example, adopted conditions may include a contained amount of a polymerization initiator of about 0.01 to 10 mol % with respect to a monomer, a monomer concentration of about 10 to 100% by mass, an atmosphere of an inert gas such as nitrogen, a reaction temperature of about −100 to 150° C., and a reaction time of about 1 to 48 hours.

In the present invention, the specific acrylic-based copolymer may be a copolymer formed by only the specific acrylic-based monomer (2) and the specific acrylic-based monomer (3). Alternatively, the specific acrylic-based copolymer may be a copolymer formed by the specific acrylic-based monomer (2), the specific acrylic-based monomer (3), and another polymerizable monomer.

As examples of another polymerizable monomer that can be copolymerized with the specific acrylic-based monomer (2) and the specific acrylic-based monomer (3), may be mentioned a (meth)acrylic ester-based monomer, a styrene-based monomer, and a polymerizable monomer having an ionic dissociation group. Especially, as another polymerizable monomer, a (meth)acrylic ester-based monomer and a styrene-based monomer are preferably used.

As examples of the (meth)acrylic ester-based monomer, the styrene-based monomer and the polymerizable monomer having an ionic dissociation group, which are another polymerizable monomer, may be mentioned those similar to the specific examples mentioned with respect to the specific acrylic-based monomer (1).

In the present invention, it is preferred, from the viewpoint of improving crush resistance of the toner, that a copolymer configured by the specific acrylic-based monomer (2), the specific acrylic-based monomer (3) and a (meth)acrylic ester-based monomer, particularly butyl acrylate, is used as a specific acrylic-based copolymer.

The specific acrylic-based monomer (2) and the specific acrylic-based monomer (3) each are a compound that has especially favorable radical polymerization properties and can be copolymerized with a vinyl monomer such as styrene, methyl methacrylate and acrylonitrile. In order to obtain a binder resin having a storage modulus necessary for the toner to develop low temperature fixability, the length of a side chain needs to be adequately controlled. The specific acrylic-based monomer (2) and the specific acrylic-based monomer (3) according to the present invention each have a structural characteristic of having two ester groups in the monomer. These ester groups act as a bulky substituent in the polymer. Therefore, a main chain becomes remarkably rigid. That is, a normal temperature modulus and heat resistance can be improved while maintaining low temperature fixability. Also, even when the specific acrylic-based monomer (2), the specific acrylic-based monomer (3), and butyl acrylate are copolymerized, the substituents do not repel each other, and the entanglement between molecules is increased. Thus, the physical durability of a toner can be improved.

In the specific acrylic-based copolymer, the ratio by mass between the specific acrylic-based monomer (2) and the specific acrylic-based monomer (3) (specific acrylic-based monomer (2): specific acrylic-based monomer (3)) is preferably 50:50 to 99:1, more preferably 60:40 to 90:10.

When the ratio by mass between a specific acrylic-based monomer (2) and a specific acrylic-based monomer (3) falls within the above-described range, excellent heat-resistant storage properties and crush resistance can be ensured while having sufficient low temperature fixability.

When at least one of $R^9$ and $R^{10}$ in the specific acrylic-based monomer (3) is an aliphatic hydrocarbon group wherein the number of carbon atoms constituting a main chain is 6 to 10, the ratio by mass is preferably 60:40 to 99:1, more preferably 60:40 to 90:10. Furthermore, when at least one of $R^9$ and $R^{10}$ in the specific acrylic-based monomer (3) is an aliphatic hydrocarbon group wherein the number of carbon atoms constituting a main chain is 11 to 60, the ratio by mass is preferably 70:30 to 99:1, more preferably 70:30 to 90:10.

The content (copolymerization ratio) of a total amount of the specific acrylic-based monomer (2) and the specific acrylic-based monomer (3) is preferably 40 to 95% by mass, more preferably 50 to 90% by mass, per a total amount of monomers for forming the specific acrylic-based copolymer.

When the content of a total amount of the specific acrylic-based monomer (2) and the specific acrylic-based monomer (3) falls within the above-described range, excellent heat-resistant storage properties and crush resistance can be ensured while having sufficient low temperature fixability.

Also, the content (copolymerization ratio) of the (meth) acrylic ester-based monomer in the copolymer configured by the specific acrylic-based monomer (2), the specific acrylic-based monomer (3) and the (meth)acrylic ester-based monomer is preferably 5 to 40% by mass per a total amount of monomers for forming the specific acrylic-based copolymer. Especially, when butyl acrylate is used as the (meth)acrylic ester-based monomer, the content (copolymerization ratio) of butyl acrylate is preferably 5 to 40% by mass per a total amount of monomers for forming the specific acrylic-based copolymer.

Furthermore, the content (copolymerization ratio) of the styrene-based monomer in the copolymer configured by the specific acrylic-based monomer (2), the specific acrylic-based monomer (3) and the styrene-based monomer is preferably 5 to 20% by mass per a total amount of monomers for forming the specific acrylic-based copolymer.

The specific acrylic-based copolymer according to the present invention is prepared by copolymerizing at least the specific acrylic-based monomer (2) and the specific acrylic-based monomer (3). Therefore, the specific acrylic-based copolymer contains structural units represented by the following formulas (2) to (3). Such a specific acrylic-based copolymer may be a block copolymer or a random copolymer. A random copolymer is preferred from the viewpoint of obtaining a specific acrylic-based copolymer that does not show the properties (low normal temperature elastic modulus and low heat resistance) of a homopolymer of each monomer.

[Chemical Formula 4]

Formula (2)

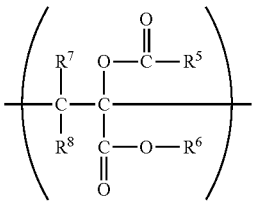

-continued

Formula (3)

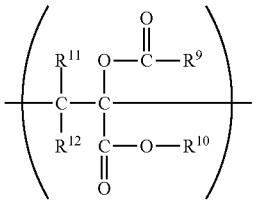

In the formula (2) and formula (3) above, $R^5$ to $R^8$ have the same meaning as $R^5$ to $R^8$ in the general formula (2) above; and $R^9$ to $R^{12}$ have the same meaning as $R^9$ to $R^{12}$ in the general formula (3) above.

In the specific acrylic-based copolymer, the peak molecular weight obtained by a molecular weight distribution based on a styrene equivalent molecular weight measured by gel permeation chromatography (GPC) is preferably 1,500 to 60,000, more preferably 3,000 to 40,000.

In the present invention, the molecular weight of the specific acrylic-based copolymer is measured in the same manner as in the above-described measurement method of the molecular weight of the specific acrylic-based polymer, except that the measurement sample is the specific acrylic-based copolymer.

The preparation method of the specific acrylic-based monomer (1) to the specific acrylic-based monomer (3) described above are not particularly limited. For example, with regard to the specific acrylic-based monomer (1) wherein both $R^3$ and $R^4$ in the general formula (1) are a hydrogen atom, a reaction represented by a reaction formula (I) can be adopted.

Reaction Formula (I)

[Chemical Formula 5]

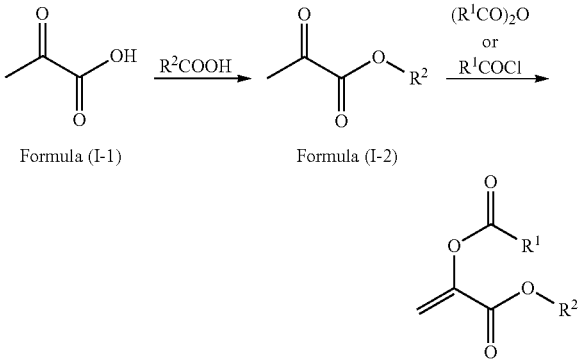

Formula (I-1) Formula (I-2) Formula (I-3)

$R^1$ and $R^2$ in the reaction formula (I) has the same meaning as $R^1$ and $R^2$ in the general formula (1).

A formula (I-1) represents pyruvic acid. The pyruvic acid is used as a so-called biomass material. Therefore, the acrylic-based polymer (1) to the acrylic-based polymer (3) according to the present invention can be obtained from a raw material derived from a biomass material. By using such a monomer, an environmental load can be suppressed to a low level.

Here, the reaction condition of esterification or the like in such a reaction formula (I) is not particularly limited, and may be appropriately modified according to the used compound type ($R^2COOH$ or $R^1COCl$ in the reaction formula (I)) and the like. Also, since ethyl pyruvate or the like (pyruvic ester represented by a formula (I-2) in the reaction formula (I)) is commercially available, the pyruvic acid represented by the formula (I-1) may not be used, and the pyruvic ester represented by the formula (I-2) (a commercially available product) may be used from the beginning. In that case, the pyruvic ester is reacted with $R^1COCl$, $(R^1CO)_2O$ or the like to produce a final product (a compound represented by a formula (I-3)).

The binder resin that constitutes the toner according to the present invention may be configured by only the specific acrylic-based polymer or the specific acrylic-based copolymer. Alternatively, the binder resin may be a mixture of at least one of the specific acrylic-based polymer and the specific acrylic-based copolymer, and another resin.

When the binder resin is a mixture with another resin, the content of another resin is preferably 10 to 40% by mass in the binder resin.

Colorant:

When the toner particle according to the present invention is configured to contain a colorant, commonly known dyes and pigments can be used as the colorant.

As examples of the colorant for obtaining a black toner, may be mentioned carbon black, a magnetic body, and iron-titanium composite oxide black. As examples of the carbon black, may be mentioned channel black, furnace black, acetylene black, thermal black, and lamp black. Also, as examples of the magnetic body, may be mentioned ferrite and magnetite.

As the colorant for obtaining a yellow toner, may be mentioned dyes such as C. I. Solvent Yellow 19, 44, 77, 79, 81, 82, 93, 98, 103, 104, 112, and 162; and pigments such as C. I. Pigment Yellow 14, 17, 74, 93, 94, 138, 155, 180, and 185.

As the colorant for obtaining a magenta toner, may be mentioned dyes such as C. I. Solvent Red 1, 49, 52, 58, 63, 111, and 122; and pigments such as C. I. Pigment Red 5, 48:1, 53:1, 57:1, 122, 139, 144, 149, 166, 177, 178, and 222.

As the colorant for obtaining a cyan toner, may be mentioned dyes such as C. I. Solvent Blue 25, 36, 60, 70, 93, and 95; and pigments such as C. I. Pigment Blue 1, 7, 15, 60, 62, 66, and 76.

The colorant for obtaining each color toner may be used either singly or in any combination thereof for each color.

The content of a colorant is preferably 0.5 to 20% by mass, more preferably 2 to 10% by mass, in the toner particle.

Magnetic Powder:

Also, when the toner particle according to the present invention is configured to contain magnetic powder, as examples of the magnetic powder, may be used magnetite, γ-hematite, or various ferrites.

The content of magnetic powder is preferably 10 to 500% by mass, more preferably 20 to 200% by mass, in the toner particle.

Parting Agent:

Also, when the toner particle according to the present invention is configured to contain a parting agent, no particular limitation should be made, and commonly known waxes can be used as the parting agent. As examples of the wax, may be mentioned polyolefin such as low molecular weight polypropylene and polyethylene or oxidized low molecular weight polypropylene and polyethylene, paraffin, and synthesized ester waxes. Especially, synthesized ester waxes have a low melting point and a low viscosity, and therefore are preferably used. As the synthesized ester waxes, behenyl behenate, glycerin tribehenate, pentaerythritol tetrabehenate and the like are particularly preferably used.

The content of a parting agent is preferably 1 to 30% by mass, more preferably 3 to 15% by mass in the toner particle.

Charge Control Agent:

Also, when the toner particle according to the present invention is configured to contain a charge control agent, the charge control agent is not particularly limited as long as the charge control agent is a substance that can provide a positive or negative charge by a friction charge, and colorless. Various publicly known positively charged charge control agents and negatively charged charge control agents can be employed.

The content of a charge control agent is preferably 0.01 to 30% by mass, more preferably 0.1 to 10% by mass in the toner particle.

The glass transition temperature of the toner according to the present invention is preferably 40 to 80° C., more preferably 40 to 70° C.

When the glass transition temperature of the toner according to the present invention falls within the above-described range, low temperature fixability can be sufficiently obtained.

In the present invention, the glass transition temperature of a toner can be measured using a differential scanning calorimeter "DSC-7" (manufactured by PerkinElmer, Inc.).

Specifically, 4.5 mg of a measurement sample (a toner) is sealed in an aluminum pan "KIT No. 0219-0041," and the pan is set in a sample holder of "DSC-7." An empty aluminum pan was used for reference measurement. A measurement was performed under the condition of a measurement temperature of 0° C. to 200° C., a temperature rise rate of 10° C./min, a temperature drop rate of 10° C./min, and Heat-cool-Heat temperature control. An analysis was performed based on the data of the 2nd. Heat. As to the glass transition temperature, an extension line of a base line before rising of the first endothermic peak and a tangent line indicating a maximum inclination in the range from a rising part to a peak top of the first endothermic peak are drawn. Then, an intersection point therebetween is shown as a glass transition temperature. In this case, during the 1st. Heat temperature rise, 200° C. was maintained for 5 minutes.

The softening point of the toner according to the present invention is preferably 80 to 110° C., more preferably 90 to 105° C.

The softening point of the toner according to the present invention is measured as follows.

First, 1.1 g of a toner was put in a petri dish and flattened in an environment of 20° C. and 50% RH. Then, the sample was left to stand for 12 hours or longer. Thereafter, the sample was pressurized for 30 seconds with a force of 3820 kg/cm$^2$ using a molding machine "SSP-10A" (manufactured by Shimadzu Corporation) to prepare a column-shaped molded sample having a diameter of 1 cm. Next, after preheating was completed, the molded sample was extruded through a hole (1 mm in diameter×1 mm) of a column-shaped die, using a piston having a diameter of 1 cm, under the condition of a load of 196 N (20 kgf), an onset temperature of 60° C., a preheating time of 300 seconds and a temperature rise rate of 6° C./rain, by a flow tester "CFT-500D" (manufactured by Shimadzu Corporation), in an environment of 24° C. and 50% RH. An offset method temperature $T_{offset}$ measured by setting the offset value at 5 mm in a melting temperature measurement method of a temperature rise method is defined as a softening point.

Average Particle Size of Toner:

The average particle size of the toner particle according to the present invention is, for example, preferably 4 to 10 more preferably 6 to 9 μm, in terms of a volume-based median diameter.

When the volume-based median diameter falls within the above-described range, transfer efficiency is increased to improve a half-tone image. Thus, an image quality of a fine line, a dot and the like is improved.

The volume-based median diameter of the toner is measured and calculated using a measuring device in which a computer system (manufactured by Beckman Coulter, Inc.) installed with a data processing software "Software V3.51" is connected to "Coulter Multisizer TA-III" (manufactured by Beckman Coulter, Inc.)

Specifically, 0.02 g of a toner was added in 20 mL of a surfactant solution, and the mixture was mixed thoroughly. The surfactant solution was obtained by, for example, diluting a neutral detergent containing a surfactant component 10 times with pure water for the purpose of dispersion of toner particles. Then, an ultrasonic dispersion was performed for one minute to prepare a toner dispersion liquid. The toner dispersion liquid was poured using a pipet in a beaker containing "ISOTON II" (manufactured by Beckman Coulter, Inc.) therein placed in a sample stand until the concentration displayed in the measuring device reaches 8%.

Here, when the concentration falls within this range, a reproducible measurement value can be obtained. Then, in the measuring device, a frequency value is calculated under the condition of a measurement particle count number of 25,000, an aperture diameter of 50 μm, and a measurement range of 1 to 30 μm divided into 256 portions. A particle size corresponding to 50% from the largest volume-integrated fraction is defined as a volume-based median diameter.

Average Roundness of Toner:

In the toner according to the present invention, the toner particles constituting the toner have an average roundness of preferably 0.950 to 0.980 from the viewpoint of improvement in transfer efficiency.

The average roundness of a toner is measured using "FPIA-2100" (manufactured by Sysmex Corporation). Specifically, a toner is mixed thoroughly in an aqueous solution containing a surfactant. The mixture is subjected to an ultrasonic dispersion treatment for one minute for dispersion. Thereafter, using "FPIA-2100" (manufactured by Sysmex Corporation), photographing is performed under the measurement condition of an HPF (high magnification photographing) mode and at a proper concentration of an HPF detection number of 3,000 to 10,000. The roundness of each toner particle is calculated according to a following formula (T). The roundness of each toner particle is added to each other, and the obtained value is divided by a total number of toner particles, thereby calculating an average roundness. When the HPF detection number falls within the above-described range, reproducibility can be obtained.

Roundness=(Perimeter of circle having the same projected area as particle image)/(Perimeter of particle projection image) Formula (T):

According to the toner described above, the binder resin contains at least one of the specific acrylic-based polymer prepared by polymerizing the specific acrylic-based monomer (1), and the specific acrylic-based copolymer prepared by copolymerizing the specific acrylic-based monomer (2) and the specific acrylic-based monomer (3). Therefore, the toner has excellent heat-resistant storage properties and crush resistance while having sufficient low temperature fixability.

Also, in the toner described above, since the specific acrylic-based monomer is a monomer derived from a biomass material, that is pyruvic acid, the specific acrylic-based (co) polymer can be obtained from a plant-derived material. Therefore, an environmental load can be suppressed to a low level.

Production Method of Toner:

The production method of the toner according to the present invention is not particularly limited. Examples thereof may include a kneading and pulverizing method, a suspension polymerization method, an emulsion aggregation method, an emulsion polymerization aggregation method, a mini-emulsion polymerization aggregation method, and other publicly known methods. Especially, from the viewpoint of reduction in energy cost during production, it is preferred to adopt an emulsion polymerization aggregation method by performing an emulsion polymerization or a mini-emulsion polymerization using a specific polymerizable monomer in an aqueous medium so as to prepare a fine particle including a binder resin that contains at least one of a specific acrylic-based polymer and a specific acrylic-based copolymer (hereinafter, also referred to as a "binder resin fine particle"), and aggregating and fusing the binder resin fine particles together with other toner particle components as necessary. Also, the method of producing a toner by a suspension polymerization method disclosed in Japanese Patent Application Laid-Open No. 2010-191043 may be preferably adopted.

In the emulsion polymerization aggregation method, the binder resin fine particle can also have a structure of containing two or more layers each including a binder resin that has a different composition. In this case, a multi-stage polymerization method can be adopted. In the multi-stage polymerization, in a dispersion liquid of a first resin fine particle prepared by an emulsion polymerization process (first stage polymerization) according to a method known per se in the art, a polymerization initiator and a polymerizable monomer are added, and this system is subjected to a polymerization process (second stage polymerization).

An example of the production process of the toner according to the present invention obtained by an emulsion polymerization aggregation method is shown below:

(1A) a binder resin fine particle polymerization step of acting in an aqueous medium a radical polymerization initiator to a polymerizable monomer for forming a binder resin to obtain binder resin fine particles, (1B) a colorant fine particle dispersion liquid preparation step of preparing a dispersion liquid of fine particles by a colorant (hereinafter, also referred to as a "colorant fine particles") as necessary, (2) an association step of adding an aggregating agent in an aqueous medium with the binder resin fine particles and the colorant fine particles present therein, and developing salting-out while performing aggregation and fusion, to form an associated particle, (3) an aging step of controlling the shape of the associated particles thereby to form a toner, (4) a filtering and washing step of filtering off toner particles from the aqueous medium, and removing a surfactant or the like from the toner particles, (5) a drying process of drying the washed toner particles, and (6) an external additive addition step of adding an external additive to the dried toner particles.

Here, an "aqueous medium" refers to a medium including 50 to 100% by mass of water and 0 to 50% by mass of an water-soluble organic solvent. As examples of the water-soluble organic solvent, may be mentioned methanol, ethanol, isopropanol, butanol, acetone, methyl ethyl ketone and tetrahydrofuran. An alcohol-based organic solvent which does not dissolve the obtained resin is preferably used. As examples of such an alcohol-based organic solvent, may be mentioned methanol, ethanol, isopropanol, and butanol.

As a method of containing a parting agent in a toner particle, may be mentioned a method of configuring binder resin fine particles so as to contain a parting agent. As another method, may be mentioned a method of adding a dispersion liquid in which parting agent fine particles are dispersed in an aqueous medium in an association step of forming a toner particle, to salt out, aggregate and fuse binder resin fine particles, colorant fine particles, and parting agent fine particles. These methods may be combined.

Also, as a method of containing a charge control agent in a toner particle, may be mentioned a method similar to the above-described method of containing a parting agent.

(1A) Binder Resin Fine Particle Polymerization Step:

This binder resin fine particle polymerization step includes, specifically, for example, adding a specific acrylic-based monomer and, as necessary, another polymerizable monomer in an aqueous medium; giving a mechanical energy for dispersion to form an oil drop; and, in this state, subjecting the specific acrylic-based monomer to a radical polymerization reaction, to thereby forming binder resin fine particles having a size of approximately 50 to 300 nm in terms of a volume-based median diameter, for example.

A dispersing apparatus for giving a mechanical energy so as to form an oil drop should not be particularly limited. As an exemplary dispersing apparatus, may be mentioned a commercially available stirrer "CLEAR MIX" (manufactured by M Technique Co., Ltd.) equipped with a rotor that rotates at high speed. Other than the foregoing stirrer equipped with a rotor capable of rotating at high speed, an apparatus such as an ultrasonic dispersion apparatus, a mechanical homogenizer, a Manton-Gaulin, and a pressure-type homogenizer may be used.

The temperature associated with a radical polymerization reaction varies depending on a type of a polymerizable monomer and a radical polymerization initiator used. For example, the temperature is preferably 50 to 100° C., more preferably 55 to 90° C. Also, the time taken for a radical polymerization reaction varies depending on a type of a used polymerizable monomer and a reaction rate of a radical from a radical polymerization initiator. For example, the time is preferably 2 to 12 hours.

Dispersion Stabilizer:

In the binder resin fine particle polymerization step, a dispersion stabilizer can be appropriately added in order to stably disperse fine particles in an aqueous medium.

As examples of the dispersion stabilizer, may be mentioned tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. Also, a substance commonly used as a surfactant, such as polyvinyl alcohol, gelatine, methylcellulose, sodium dodecylbenzenesulfonate, ethylene oxide adducts, and higher alcohol sodium sulfate can also be used as a dispersion stabilizer.

As such a surfactant, may be used various publicly known ionic surfactants, nonionic surfactants and the like.

As examples of the ionic surfactant, may be mentioned sulfonic acid salts such as sodium dodecylbenzenesulfonate, sodium arylalkylpolyethersulfonate, sodium 3,3-disulfonediphenylurea-4,4-diazo-bis-amino-8-naphthol-6-sulfonate, ortho-carboxybenzene-azo-dimethylaniline, and sodium 2,2,5,5-tetramethyl-triphenylmethane-4,4-diazo-bis-β-naphthol-6-sulfonate; sulfuric ester salts such as sodium dodecyl sulfate, sodium tetradecyl sulfate, sodium pentadecyl sulfate, and sodium octyl sulfate, and fatty acid salts such as sodium oleate, sodium laurate, sodium caprate, sodium caprylate, sodium caproate, potassium stearate, and calcium oleate.

Also, as examples of the nonionic surfactant, may be mentioned polyethylene oxide, polypropylene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, and sorbitan ester.

Polymerization Initiator:

As the polymerization initiator used in the binder resin fine particle polymerization step, may be used water-soluble polymerization initiators such as potassium persulfate, ammonium persulfate, and azobiscyanovaleric acid; water-soluble redox polymerization initiators such as hydrogen peroxide-ascorbic acid; and oil-soluble polymerization initiators such as azobisisobutyronitrile and azobisvaleronitrile.

Chain Transfer Agent:

In the binder resin fine particle polymerization step, a commonly used chain transfer agent can be used for the purpose of adjusting the molecular weights of a specific acrylic-based polymer and a specific acrylic-based copolymer. The chain transfer agent should not be particularly limited. Examples thereof may include n-octyl mercaptan, n-dodecyl mercaptan, tert-dodecyl mercaptan, and tetrachloromethane.

(1B) Colorant Fine Particle Dispersion Liquid Preparation Step:

This colorant fine particle dispersion liquid preparation step is performed as necessary when a toner particle containing a colorant is desired. In this step, a colorant is dispersed in a shape of fine particles in an aqueous medium to prepare a dispersion liquid of colorant fine particles.

Dispersion of a colorant may be performed by utilizing a mechanical energy.

The volume-based median diameter of colorant fine particles in a dispersed state is preferably 10 to 300 nm, more preferably 100 to 200 nm, particularly preferably 100 to 150 nm.

The volume-based median diameter of colorant fine particles is measured using an electrophoretic light scattering spectrophotometer "ELS-800" (manufactured by Otsuka Electronics Co., Ltd.).

With respect to (2) the association step to (6) the external additive addition step, the steps can be performed according to various publicly known processes.

Aggregating Agent:

Although the aggregating agent used in the association step should not be particularly limited, a substance selected from metal salts is suitably used. As examples of the metal salts, may be mentioned monovalent metal salts like alkali metal salts such as sodium, potassium, and lithium salts; divalent metal salts such as calcium, magnesium, manganese and copper salts; and trivalent metal salts such as iron and aluminum salts. As specific examples of the metal salts, may be mentioned sodium chloride, potassium chloride, lithium chloride, calcium chloride, magnesium chloride, zinc chloride, copper sulfate, magnesium sulfate, and manganese sulfate. Among these, divalent metal salts are particularly preferably used, since aggregation can be developed with a small amount thereof. These may be used either singly or in any combination thereof.

External Additive:

The toner particle can constitute the toner according to the present invention as is. In order to improve fluidity, charging properties, cleaning properties and the like, the toner according to the present invention may be configured by adding in the toner particle an external additive such as a fluidizer and a cleaning auxiliary which are a so-called post-treatment agent.

As examples of the external additive, may be mentioned inorganic oxide fine particles such as silica fine particles, alumina fine particles, and titanium oxide fine particles; inorganic stearic acid compound fine particles such as aluminum stearate fine particles and zinc stearate fine particles; and inorganic titanic acid compound fine particles such as strontium titanate and zinc titanate. These may be used either singly or in any combination thereof.

These inorganic fine particles are preferably subjected to a surface treatment with a silane coupling agent, a titanium coupling agent, higher fatty acid, silicone oil and the like, in order to improve heat-resistant storage properties and environmental stability.

The total added amount of these various external additives is 0.05 to 5 parts by mass, preferably 0.1 to 3 parts by mass, per 100 parts by mass of the toner. Also, various external additives may be used in combination.

Developer:

The toner according to the present invention may be used as a magnetic or non-magnetic one-component developer as well as a two-component developer with a carrier mixed therein.

When the toner is used as a two-component developer, the mixed amount of the toner to a carrier is preferably 2 to 10% by mass.

A mixing device for mixing a toner and a carrier is not particularly limited. As examples of the mixing device, may be mentioned a Nauta mixer, and a W-cone or V-type mixer.

As the carrier, may be used magnetic particles made of conventionally known materials including: a metal such as iron, ferrite and magnetite; and an alloy of these metals and a metal such as aluminum and lead. Particularly, ferrite particles are preferred.

Also, as the carrier, may be used a coated carrier obtained by covering the surface of a magnetic particle with a coating agent such as a resin, or a binder-type carrier obtained by dispersing magnetic substance fine powder in a binder resin, and the like.

A covering resin constituting the coated carrier is not particularly limited. As examples thereof, may be mentioned olefin-based resins, styrene-based resins, styrene-acrylic-based resins, silicone-based resins, ester resins, and fluorine resins. Also, a resin constituting a resin dispersion type carrier is not particularly limited, and publicly known resins such as styrene-acrylic-based resins, polyester resins, fluorine resins, and phenol resins can be used.

The volume-based median diameter of a carrier is preferably 20 to 100 μm, more preferably 20 to 60 μm. A volume-based median diameter of a carrier can be typically measured using a laser diffraction particle size distribution analyzer "HELOS" (manufactured by Sympatec Co.) equipped with a wet disperser.

Image Formation Process:

The toner according to the present invention can be suitably used in an image formation process including a fixing step by a thermal pressure fixing system in which pressure and heat can be given at the same time. In particular, the toner can be suitably used in an image formation process in which a toner is fixed at a relatively low fixing temperature in a fixing step. In this case, the surface temperature of a heating member in a fixing nip part is 80 to 110° C., preferably 80 to 95° C.

Furthermore, the toner can be used in an image formation process of high speed fixing at a fixing linear speed of 200 to 600 mm/sec.

In this image formation process, specifically, the above-described toner is used to obtain a toner image by, for example, developing an electrostatic latent image formed on a photoreceptor. This toner image is transferred on an image support body. Thereafter, the toner image transferred on the image support body is fixed by a fixing treatment of a thermal pressure fixing system, thereby obtaining a printed matter with a visible image formed thereon.

Image Support Body:

As an image support body used in an image formation process in which the toner according to the present invention is used, may be specifically used coated printing paper such as plain paper, high quality paper, art paper, and coated paper with a thickness of from thin to thick, and a variety of printing paper such as commercially available Japanese paper and postcard paper, for example, although the present invention is not limited thereto.

In the above, the embodiments of the present invention have been specifically described. However, embodiments of the present invention should not be limited to the above-described examples, and various modifications can be made thereto.

EXAMPLES

Although specific examples of the present invention will be described below, the present invention shall not be limited to those examples.

Specific Acrylic-Based Monomer Synthesis Example 1

First, to a mixture of ethyl pyruvate (315 g, 2.7 mol) and acetic anhydride (554 g, 5.4 mol), p-toluenesulfonic acid monohydrate (8 g) was added. Then, the mixture was stirred under a nitrogen gas stream at 120° C. for 24 hours to obtain a reaction solution. Next, acetic acid generated by a reaction with excess acetic anhydride under reduced pressure (40 to 50 mmHg) was removed from the reaction solution. Thereafter, the residue was purified by reduced pressure distillation (35 to 40 mmHg, 90 to 103° C.) to obtain ethyl α-acetoxyacrylate (250 g, yield 58%).

Here, ethyl α-acetoxyacrylate is a monomer that can be utilized as a specific acrylic-based monomer represented by the general formula (1) (a compound wherein in the general formula (1), $R^1$ is a methyl group, $R^2$ is an ethyl group, and $R^3$ and $R^4$ are each a hydrogen atom), or a specific acrylic-based monomer represented by the general formula (2) (a compound wherein in the general formula (2), $R^5$ is a methyl group, $R^6$ is an ethyl group, and $R^7$ and $R^8$ are each a hydrogen atom). Hereinafter, this ethyl α-acetoxyacrylate is also referred to as "EAA."

Specific Acrylic-Based Monomer Synthesis Example 2

First, a toluene (1 L) solution of pyruvic acid (440 g, 5.0 mol), n-butanol (371 g, 5.0 mol) and p-toluenesulfonic acid monohydrate (2.5 g) was heated and refluxed for 16 hours while removing water under a nitrogen gas stream, whereby a first reaction solution was obtained. Next, the first reaction solution was cooled to room temperature (25° C.). Thereafter, toluene was removed under reduced pressure (40 mmHg) using an evaporator, and the residue was purified by reduced pressure distillation (40 mmHg, 93 to 100° C.), whereby butyl pyruvate (505 g, yield 70%) was obtained.

Next, in a mixture of the obtained butyl pyruvate (235 g, 1.6 mol) and acetic anhydride (333 g, 3.3 mol), p-toluenesulfonic acid monohydrate (5 g) was added. Then, the mixture was stirred under a nitrogen gas stream at 120° C. for 25 hours to obtain a second reaction solution. Next, acetic acid generated by a reaction with excess acetic anhydride under reduced pressure (5 mmHg) was removed from the second reaction solution. Thereafter, the residue was purified by reduced pressure distillation (2 mmHg, 56 to 63° C.) to obtain butyl α-acetoxyacrylate (200 g, yield 67%).

Here, butyl α-acetoxyacrylate is a monomer that can be utilized as a specific acrylic-based monomer represented by the general formula (1) (a compound wherein in the general formula (1), $R^1$ is a methyl group, $R^2$ is a butyl group, and $R^3$ and $R^4$ are each a hydrogen atom), or a specific acrylic-based monomer represented by the general formula (3) (a compound wherein in the general formula (3), $R^9$ is a methyl group, $R^{10}$ is a butyl group, and $R^{11}$ and $R^{12}$ are each a hydrogen atom). Hereinafter, the butyl α-acetoxyacrylate is also referred to as "BAA."

Specific Acrylic-Based Monomer Synthesis Example 3

A toluene (1 L) solution of pyruvic acid (440 g, 5.0 mol), n-octanol (651 g, 5.0 mol) and p-toluenesulfonic acid monohydrate (2.5 g) was heated and refluxed for 16 hours while removing water under a nitrogen gas stream, thereby obtaining a first reaction solution. Next, the first reaction solution was cooled to room temperature (25° C.). Thereafter, toluene was removed under reduced pressure (40 mmHg) using an evaporator, and the residue was purified by reduced pressure distillation (2 mmHg, 82 to 92° C.), thereby obtaining octyl pyruvate (762 g, yield 76%).

Next, in a mixture of the obtained octyl pyruvate (300 g, 1.5 mol) and acetic anhydride (306 g, 3.0 mol), p-toluenesulfonic acid monohydrate (5 g) was added. Then, the mixture was stirred under a nitrogen gas stream at 120° C. for 27 hours, thereby obtaining a second reaction solution. Next, acetic acid generated by a reaction with excess acetic anhydride under reduced pressure (5 mmHg) was removed from the second reaction solution. Thereafter, the residue was purified by reduced pressure distillation (1 mmHg or less, 80 to 102° C.), thereby obtaining octyl α-acetoxyacrylate (215 g, yield 59%).

Here, octyl α-acetoxyacrylate is a monomer that can be utilized as a specific acrylic-based monomer represented by the general formula (1) (a compound wherein in the general formula (1), $R^1$ is a methyl group, $R^2$ is an octyl group, and $R^3$ and $R^4$ are each a hydrogen atom), or a specific acrylic-based monomer represented by the general formula (3) (a compound wherein in the general formula (3), $R^9$ is a methyl group, $R^{10}$ is an octyl group, and $R^{11}$ and $R^{12}$ are each a hydrogen atom). Hereinafter, the octyl α-acetoxyacrylate is also referred to as "OAA."

Toner Production Example 1

(1) Preparation of Resin Fine Particle Dispersion Liquid (a) First Stage Polymerization:

In a reaction vessel equipped with a stirrer, a temperature sensor, a condenser, and a nitrogen-introducing device, a surfactant solution of 4 parts by mass of sodium polyoxyethylene (2) dodecyl ether sulfate dissolved in 3000 parts by mass of ion exchanged water was charged. The internal temperature of the solution was increased to 80° C. while stirring the solution at a stirring speed of 230 rpm under a nitrogen gas stream.

Into the surfactant solution, an initiator solution of 5 parts by mass of a polymerization initiator (potassium persulfate: KPS) dissolved in 200 parts by mass of ion exchanged water was added, and the liquid temperature was set at 75° C. Thereafter, a monomer mixed liquid including 560 parts by mass of EAA, 240 parts by mass of BAA, and 68 parts by mass of methacrylic acid was dropwisely added for one hour. This system was heated and stirred at 75° C. for 2 hours to perform polymerization, thereby preparing a resin fine particle dispersion liquid [α]

(b) Second Stage Polymerization:

Using a mechanical disperser "CLEAR MIX" (manufactured by M Technique Co., Ltd.), a monomer mixed liquid including 132 parts by mass of EAA, 57 parts by mass of BAA, 20 parts by mass of methacrylic acid, 0.5 parts by mass of n-octyl mercaptan, and 82 parts by mass of "WEP-5" (manufactured by Nippon Oil & Fats Co., Ltd.) was mixed and dispersed for one hour. Thus, an emulsified dispersion liquid [1b] containing emulsified particles was prepared.

Ina reaction vessel equipped with a stirrer, a temperature sensor, a condenser, and a nitrogen-introducing device, a surfactant solution of 2 parts by mass of sodium polyoxyethylene(2)dodecyl ether sulfate dissolved in 1270 parts by mass of ion exchanged water was charged, and the temperature was increased to 80° C. Thereafter, 40 parts by mass based on a solid content of the resin fine particle dispersion liquid [1a] was added. Furthermore, after the liquid temperature was controlled at 80° C., the emulsified dispersion liquid [1b] was added. In the mixture, an initiator solution of 5 parts by mass of a polymerization initiator (potassium persulfate: KPS) dissolved in 100 parts by mass of ion exchanged water was added. This system was heated and stirred at 80° C. for one hour to perform polymerization, thereby preparing a resin fine particle dispersion liquid [1].

(2) Preparation of Colorant Fine Particle Dispersion Liquid

While a solution of 27 parts by mass of sodium n-dodecyl sulfate added in 500 parts by mass of ion exchanged water was stirred, 30 parts by mass of carbon black as a colorant was gradually added. Next, a dispersion treatment was performed using a mechanical disperser "CLEAR MIX" (manufactured by M Technique Co., Ltd.), thereby preparing a colorant fine particle dispersion liquid [1].

(3) Formation of Toner Particles 1250 parts by mass of the resin fine particle dispersion liquid [1], 2000 parts by mass of ion exchanged water, and 165 parts by mass of the colorant fine particle dispersion liquid [1] were placed in a reaction vessel equipped with a temperature sensor, a condenser, a nitrogen-introducing device, and a stirrer, and stirred to prepare a solution for association. After the internal temperature of this solution for association was adjusted at 30° C., 5 mol/L of an aqueous sodium hydroxide solution was added to adjust its pH at 10.0. Next, an aqueous solution of 52.6 parts by mass of magnesium chloride hexahydrate dissolved in 72 parts by mass of ion exchanged water was added under stirring at 30° C. for 10 minutes. After the product was left to stand for 3 minutes, temperature rise started, and the temperature of this system was increased for 6 minutes to 90° C. (temperature rise rate=10° C./min).

In this state, the average particle size of associated particles was measured by "Multisizer 3" (manufactured by Beckman Coulter, Inc.). When the volume-based median diameter reached 6.7 μm, an aqueous solution of 115 parts by mass of sodium chloride dissolved in 700 parts by mass of ion exchanged water was added to stop the growth of particles.

Furthermore, heating and stirring were performed at a liquid temperature of 90° C.±2° C. for 6 hours to continue fusion. The roundnesses of these associated particles were measured by "FPIA 2100" (manufactured by Sysmex Corporation), and the average roundness was found to be 0.958.

Next, cooling was performed to 30° C. under the condition of 6° C./rain, and the associated particles were filtrated. The particles were repeatedly washed with ion exchanged water at 45° C., and then dried with hot air at 40° C., thereby obtaining a toner particle [1]

(4) Addition of External Additive

Per 100 parts by mass of the toner particle [1], an external additive including 1.0 part by mass of silica (average primary particle size: 12 nm, hydrophobization degree: 68) treated with hexamethylsilazane and 0.3 parts by mass of titanium dioxide (average primary particle size: 20 nm, hydrophobization degree: 63) treated with n-octyl silane was added. An external addition treatment was performed using a "Henschel mixer" (manufactured by Mitsui-Miike Mining Co., Ltd.) to produce a black toner [1].

In this case, the external addition treatment by a Henschel mixer was performed under the condition of a peripheral speed of a stirring blade of 35 m/sec, a treatment temperature of 35° C., and a treatment time of 15 minutes.

Toner Production Examples 2 to 5

Toners [2] to [5] were produced in the same manner as in the toner production example 1, except that the added amounts of EAA and BAA were changed to the amounts shown in TABLE 2.

TABLE 2

| Toner | First stage polymerization | | Second stage polymerization | | Copolymerization ratio (Ratio by mass) | |
|---|---|---|---|---|---|---|
| | EAA | BAA | EAA | BAA | | |
| No. | (Parts by mass) | (Parts by mass) | (Parts by mass) | (Parts by mass) | EAA | BAA |
| [1] | 560 | 240 | 132 | 57 | 70 | 30 |
| [2] | 400 | 400 | 95 | 95 | 50 | 50 |
| [3] | 240 | 560 | 57 | 132 | 30 | 70 |
| [4] | 800 | 0 | 190 | 0 | 100 | — |
| [5] | 0 | 800 | 0 | 190 | — | 100 |

Toner Production Examples 6 to 9

Toners [6] to [9] were produced in the same manner as in the toner production example 1, except that BAA was changed to OAA, and the added amounts of OAA and EAA were changed to the amounts shown in TABLE 3.

TABLE 3

| Toner | First stage polymerization | | Second stage polymerization | | Copolymerization ratio (Ratio by mass) | |
|---|---|---|---|---|---|---|
| | EAA | OAA | EAA | OAA | | |
| No. | (Parts by mass) | (Parts by mass) | (Parts by mass) | (Parts by mass) | EAA | OAA |
| [6] | 560 | 240 | 132 | 57 | 70 | 30 |
| [7] | 400 | 400 | 95 | 95 | 50 | 50 |
| [8] | 240 | 560 | 57 | 132 | 30 | 70 |
| [9] | 0 | 800 | 0 | 190 | — | 100 |

Toner Production Examples 10 to 20

Toners [10] to [20] were produced in the same manner as in the toner production example 1, except that butyl acrylate (BA) was used in addition to EAA and BAA, and the added amounts of EAA, BAA, and BA were changed to the amounts shown in TABLE 4.

TABLE 4

| Toner | First stage polymerization | | | Second stage polymerization | | | Copolymerization ratio (Ratio by mass) | | |
|---|---|---|---|---|---|---|---|---|---|
| | EAA | BAA | BA | EAA | BAA | BA | | | |
| No. | (Parts by mass) | (Parts by mass) | (Parts by mass) | (Parts by mass) | (Parts by mass) | (Parts by mass) | EAA | BAA | BA |
| [10] | 440 | 280 | 80 | 104 | 66 | 19 | 55 | 35 | 10 |
| [11] | 400 | 240 | 160 | 95 | 57 | 38 | 50 | 30 | 20 |
| [12] | 360 | 200 | 240 | 85 | 47 | 57 | 45 | 25 | 30 |
| [13] | 616 | 40 | 320 | 104 | 9 | 76 | 55 | 5 | 40 |

TABLE 4-continued

| Toner No. | First stage polymerization EAA (Parts by mass) | First stage polymerization BAA (Parts by mass) | First stage polymerization BA (Parts by mass) | Second stage polymerization EAA (Parts by mass) | Second stage polymerization BAA (Parts by mass) | Second stage polymerization BA (Parts by mass) | Copolymerization ratio (Ratio by mass) EAA | Copolymerization ratio (Ratio by mass) BAA | Copolymerization ratio (Ratio by mass) BA |
|---|---|---|---|---|---|---|---|---|---|
| [14] | 520 | 200 | 80 | 123 | 47 | 19 | 65 | 25 | 10 |
| [15] | 360 | 360 | 80 | 85 | 85 | 19 | 45 | 45 | 10 |
| [16] | 480 | 160 | 160 | 113 | 38 | 38 | 60 | 20 | 20 |
| [17] | 320 | 320 | 160 | 76 | 76 | 38 | 40 | 40 | 20 |
| [18] | 320 | 400 | 80 | 76 | 95 | 19 | 40 | 50 | 10 |
| [19] | 640 | 0 | 160 | 152 | 0 | 38 | 80 | — | 20 |
| [20] | 0 | 640 | 160 | 0 | 152 | 38 | — | 80 | 20 |

Toner Production Examples 21 to 29

Toners [21] to [29] were produced in the same manner as in the toner production example 1, except that BAA was changed to OAA while butyl acrylate (BA) was added, and the added amounts of EAA, OAA and BA were changed to the amounts shown in TABLE 5.

TABLE 5

| Toner No. | First stage polymerization EAA (Parts by mass) | First stage polymerization OAA (Parts by mass) | First stage polymerization BA (Parts by mass) | Second stage polymerization EAA (Parts by mass) | Second stage polymerization OAA (Parts by mass) | Second stage polymerization BA (Parts by mass) | Copolymerization ratio (Ratio by mass) EAA | Copolymerization ratio (Ratio by mass) OAA | Copolymerization ratio (Ratio by mass) BA |
|---|---|---|---|---|---|---|---|---|---|
| [21] | 560 | 160 | 80 | 132 | 38 | 19 | 70 | 20 | 10 |
| [22] | 520 | 120 | 160 | 123 | 28 | 38 | 65 | 15 | 20 |
| [23] | 440 | 120 | 240 | 104 | 28 | 57 | 55 | 15 | 30 |
| [24] | 640 | 80 | 80 | 151 | 19 | 19 | 80 | 10 | 10 |
| [25] | 480 | 240 | 80 | 113 | 57 | 19 | 60 | 30 | 10 |
| [26] | 560 | 80 | 160 | 132 | 19 | 38 | 70 | 10 | 20 |
| [27] | 480 | 160 | 160 | 113 | 38 | 38 | 60 | 20 | 20 |
| [28] | 240 | 400 | 160 | 57 | 95 | 38 | 30 | 50 | 20 |
| [29] | 0 | 640 | 160 | 0 | 152 | 38 | — | 80 | 20 |

Toner Production Examples 30 to 32

Toners [30] to [32] were produced in the same manner as in the toner production example 1, except that EAA and BAA were changed to styrene and butyl acrylate (BA), and the added amounts of styrene and BA were changed to the amounts shown in TABLE 6.

TABLE 6

| Toner No. | First stage polymerization Styrene (Parts by mass) | First stage polymerization BA (Parts by mass) | Second stage polymerization Styrene (Parts by mass) | Second stage polymerization BA (Parts by mass) | Copolymerization ratio (Ratio by mass) Styrene | Copolymerization ratio (Ratio by mass) BA |
|---|---|---|---|---|---|---|
| [30] | 600 | 200 | 142 | 47 | 75 | 25 |
| [31] | 640 | 160 | 151 | 38 | 80 | 20 |
| [32] | 680 | 120 | 161 | 28 | 85 | 15 |

Measurement of Glass Transition Temperature:

The glass transition temperature (Tg) of each of the obtained toners [1] to [32] was measured using a differential scanning calorimeter "DSC-7" (manufactured by PerkinElmer, Inc.). The results are shown in TABLE 7.

Specifically, 4.5 mg of a measurement sample (a toner) is sealed in an aluminum pan "KIT No. 0219-0041," and the pan is set in a sample holder of "DSC-7." An empty aluminum pan was used for reference measurement. A measurement was performed under the condition of a measurement temperature of 0° C. to 200° C., a temperature rise rate of 10° C./min, a temperature drop rate of 10° C./min, and Heat-cool-Heat temperature control. An analysis was performed based on the data of the 2nd. Heat. As to the glass transition temperature, an extension line of a base line before rising of the first endothermic peak and a tangent line indicating a maximum inclination in the range from a rising part to a peak top of the first endothermic peak are drawn. Then, an intersection point therebetween is shown as a glass transition temperature. In this case, during the 1st. Heat temperature rise, 200° C. was maintained for 5 minutes.

Developer Preparation Examples 1 to 32

A ferrite carrier that was coated with a silicone resin and had a volume average median diameter of 60 μm was mixed to each of Toners [1] to [32] using a V-shaped mixer so as to achieve a toner concentration of 6% by mass, thereby producing developers [1] to [32].

Examples 1 to 29, Reference Examples 1 to 3

(1) Evaluation of Low Temperature Fixability

A commercially available copying machine "bizhub Pro C6500" (manufactured by Konica Minolta Business Technologies, Inc.) was modified so that the surface temperature of a heating roller in a fixing device can be changed in steps of 5° C. in a range of 120 to 170° C. In a fixing experiment, a solid image (toner attachment amount: 2.0 mg/cm$^2$) having a size of 1.5 cm×1.5 cm was fixed on an A4-sized high quality paper (64 g/m$^2$) by each of the developers [1] to [32] in a normal temperature and normal humidity (temperature 20° C., humidity 55% RH) environment. This fixing experiment was repeatedly performed by changing the fixing temperature (the surface temperature of the heating roller) to be set in increments of 5° C. at 120° C., 125° C., and so on.

The solid image obtained in each fixing experiment was folded in half along the middle portion, and peeling properties of the image were visually observed. The lowest fixing temperature in the fixing experiment in which no peeling of an image was observed was determined to be a fixing lower limit temperature. When this fixing lower limit temperature is lower than 150° C., there is no practical problem, and a judgment is made to be acceptable. The results are shown in TABLE 7.

(2) Evaluation of Heat-Resistant Storage Properties

On a propylene cup, 10 g of each of the toners [1] to [32] was weighted, and left to stand for 15 hours in an environment of a temperature of 50° C. and a humidity of 50% RH. Thereafter, the blocking (aggregation) state was evaluated in accordance with the following evaluation criteria. The results are shown in TABLE 7.

—Evaluation Criteria—

A: Simply by tilting a cup, a toner flows freely

B: By continuously putting a cup in motion for a while, a toner gradually collapses and starts flowing (without practical problem)

C: Aggregation has occurred, and by continuously putting a cup in motion, a toner starts collapsing in a lump (with practical problem)

D: Aggregation has occurred, and even when poked with a pointed matter, the aggregate is still solidified (with practical problem)

(3) Evaluation of Crush Resistance

A developing device of a commercially available copying machine "bizhub Pro C6500" (manufactured by Konica Minolta Business Technologies, Inc.) was charged with each of the developers [1] to [32], and driven for 3.5 hours at a speed of 600 rpm by a standalone drive unit. Thereafter, sampling of the developer in the developing device was performed. The particle size distribution of a toner was measured by "Multisizer 3" (manufactured by Beckman Coulter, Inc.). The measurement result was compared to that of a toner before being charged into the developing device, and the increase rate (% by mass) of a toner having a particle size of 2.5 μl or smaller was calculated. It is indicated that the higher the increase rate of a toner having a particle size of 2.5 μm or smaller is, the more likely crush in a developing device is to occur. When this increase rate is no more than 10% by mass, there is no practical problem, and a judgment was made to be acceptable. The results are shown in TABLE 7.

TABLE 7

| | | | | Evaluation | | |
|---|---|---|---|---|---|---|
| | Developer No. | Toner No. | Glass transition temperature (° C.) | Low temperature fixability (° C.) | Heat-resistant storage properties | Crush resistance (% by mass) |
| Example 1 | [1] | [1] | 78 | 140 | A | 2 |
| Example 2 | [2] | [2] | 78 | 135 | A | 2 |
| Example 3 | [3] | [3] | 75 | 135 | A | 2 |
| Example 4 | [4] | [4] | 80 | 140 | A | 5 |
| Example 5 | [5] | [5] | 72 | 130 | A | 5 |
| Example 6 | [6] | [6] | 74 | 130 | A | 3 |
| Example 7 | [7] | [7] | 70 | 130 | A | 2 |
| Example 8 | [8] | [8] | 69 | 125 | A | 2 |
| Example 9 | [9] | [9] | 50 | 120 | A | 6 |
| Example 10 | [10] | [10] | 72 | 135 | A | 2 |
| Example 11 | [11] | [11] | 64 | 120 | A | 1 |
| Example 12 | [12] | [12] | 43 | 120 | A | 1 |
| Example 13 | [13] | [13] | 40 | 120 | B | 1 |
| Example 14 | [14] | [14] | 70 | 140 | A | 1 |
| Example 15 | [15] | [15] | 70 | 140 | A | 1 |
| Example 16 | [16] | [16] | 65 | 125 | A | 1 |
| Example 17 | [17] | [17] | 63 | 120 | A | 1 |
| Example 18 | [18] | [18] | 69 | 140 | A | 1 |
| Example 19 | [19] | [19] | 67 | 125 | A | 5 |
| Example 20 | [20] | [20] | 60 | 120 | A | 5 |
| Example 21 | [21] | [21] | 78 | 125 | A | 1 |
| Example 22 | [22] | [22] | 57 | 120 | A | 1 |
| Example 23 | [23] | [23] | 36 | 120 | A | 1 |
| Example 24 | [24] | [24] | 72 | 140 | A | 1 |

TABLE 7-continued

| | Developer No. | Toner No. | Glass transition temperature (° C.) | Evaluation: Low temperature fixability (° C.) | Evaluation: Heat-resistant storage properties | Evaluation: Crush resistance (% by mass) |
|---|---|---|---|---|---|---|
| Example 25 | [25] | [25] | 71 | 130 | A | 1 |
| Example 26 | [26] | [26] | 60 | 125 | A | 1 |
| Example 27 | [27] | [27] | 54 | 125 | A | 1 |
| Example 28 | [28] | [28] | 37 | 120 | B | 1 |
| Example 29 | [29] | [29] | 35 | 120 | A | 6 |
| Reference Example 1 | [30] | [30] | 40 | 140 | D | 12 |
| Reference Example 2 | [31] | [31] | 54 | 140 | D | 10 |
| Reference Example 3 | [32] | [32] | 64 | 145 | C | 10 |

The invention claimed is:

1. A toner for developing an electrostatic image, comprising toner particles containing at least a binder resin, wherein the binder resin contains a polymer prepared by polymerizing a polymerizable monomer represented by the following general formula (1):

General Formula (1)

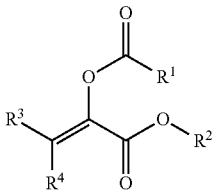

wherein in the general formula (1), $R^1$ and $R^2$ each independently represent an aliphatic hydrocarbon group having 1 to 60 carbon atoms, an aliphatic group wherein some of carbon atoms of the aliphatic hydrocarbon group are substituted with an oxygen atom, or an aromatic hydrocarbon group that may optionally have the aliphatic hydrocarbon group or the aliphatic group as a substituent; and $R^3$ and $R^4$ each independently represent a hydrogen atom or an aliphatic hydrocarbon group.

2. The toner for developing an electrostatic image according to claim 1, wherein the polymer is prepared by copolymerizing the polymerizable monomer represented by the general formula (1) and butyl acrylate.

3. The toner for developing an electrostatic image according to claim 2, wherein a content of the butyl acrylate is 5 to 40% by mass per total amount of monomers forming the polymer.

4. The toner for developing an electrostatic image according to claim 1, having a glass transition temperature of 40 to 80° C.

5. A toner for developing an electrostatic image, comprising toner particles containing at least a binder resin, wherein the binder resin contains a copolymer prepared by copolymerizing a polymerizable monomer represented by a following general formula (2) and a polymerizable monomer represented by a following general formula (3):

General Formula (2)

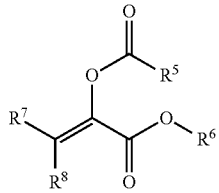

wherein in the general formula (2), $R^5$ and $R^6$ each independently represent an aliphatic hydrocarbon group having 3 or less carbon atoms, an aliphatic group wherein some of carbon atoms of the aliphatic hydrocarbon group are substituted with an oxygen atom, or an aromatic hydrocarbon group optionally having the aliphatic hydrocarbon group or the aliphatic group as a substituent wherein the number of condensations is not more than 3; and $R^7$ and $R^8$ each independently represent a hydrogen atom or an aliphatic hydrocarbon group having 3 or less carbon atoms;

General Formula (3)

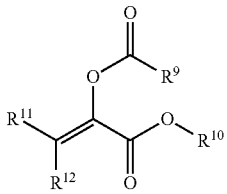

in the general formula (3), $R^9$ and $R^{10}$ each independently represent an aliphatic hydrocarbon group, an aliphatic group wherein some of carbon atoms of the aliphatic hydrocarbon group are substituted with an oxygen atom, or an aromatic hydrocarbon group that may optionally have the aliphatic hydrocarbon group or the aliphatic group as a substituent; provided that at least one of $R^9$ and $R^{10}$ represents an aliphatic hydrocarbon group having 4 to 60 carbon atoms, or an aliphatic group wherein some of carbon atoms of the aliphatic hydrocarbon group are substituted with an oxygen atom; and $R^{11}$ and $R^{12}$ each independently represent a hydrogen atom or an aliphatic hydrocarbon group.

6. The toner for developing an electrostatic image according to claim 5, wherein a mass ratio between the polymerizable monomer represented by the general formula (2) and the polymerizable monomer represented by the general formula (3) in the copolymer is 50:50 to 99:1.

7. The toner for developing an electrostatic image according to claim 5, wherein a total content of the polymerizable monomer represented by the general formula (2) and the polymerizable monomer represented by the general formula (3) is 40 to 95% by mass per total amount of monomers forming the copolymer.

8. The toner for developing an electrostatic image according to claim 5, wherein the copolymer is prepared by copolymerizing the polymerizable monomer represented by the general formula (2), the polymerizable monomer represented by the general formula (3), and butyl acrylate.

9. The toner for developing an electrostatic image according to claim 8, wherein a content of the butyl acrylate is 5 to 40% by mass per total amount of monomers forming the copolymer.

10. The toner for developing an electrostatic image according to claim 5, having a glass transition temperature of 40 to 80° C.

* * * * *